US008282470B2

(12) United States Patent
Englman et al.

(10) Patent No.: US 8,282,470 B2
(45) Date of Patent: Oct. 9, 2012

(54) WAGERING GAME WITH PLAYER-SELECTABLE ELEMENTS PROVIDING A SCRIPTED OUTCOME

(75) Inventors: Allon G. Englman, Chicago, IL (US); Jamie W. Vann, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 351 days.

(21) Appl. No.: 12/740,757

(22) PCT Filed: Nov. 7, 2008

(86) PCT No.: PCT/US2008/082776

§ 371 (c)(1),
(2), (4) Date: Apr. 30, 2010

(87) PCT Pub. No.: WO2009/062021

PCT Pub. Date: May 14, 2009

(65) Prior Publication Data

US 2010/0285870 A1 Nov. 11, 2010

Related U.S. Application Data

(60) Provisional application No. 60/986,943, filed on Nov. 9, 2007.

(51) Int. Cl.
*A63F 9/24* (2006.01)

(52) U.S. Cl. ..... 463/25; 463/16; 463/26; 463/27; 463/28

(58) Field of Classification Search ..... 463/25
See application file for complete search history.

(56) References Cited

U.S. PATENT DOCUMENTS

| | | | | |
|---|---|---|---|---|
| 6,126,542 | A | 10/2000 | Fier | |
| 6,832,956 | B1 | 12/2004 | Boyd et al. | |
| 7,033,272 | B1 | 4/2006 | Mason | |
| 7,384,335 | B2 | 6/2008 | Boyd et al. | |
| 2004/0214628 | A1 * | 10/2004 | Boyd et al. | 463/20 |
| 2006/0025205 | A1 * | 2/2006 | Casey et al. | 463/20 |
| 2007/0060263 | A1 * | 3/2007 | Englman et al. | 463/16 |

OTHER PUBLICATIONS

Written Opinion corresponding to International Patent Application Serial No. PCT/US2008/082776, United States Patent Office; dated Jan. 9, 2009; 7 pages.

(Continued)

*Primary Examiner* — David L Lewis
*Assistant Examiner* — Werner Garner
(74) *Attorney, Agent, or Firm* — Nixon Peabody LLP

(57) ABSTRACT

A gaming system for conducting a wagering game includes having a special award that includes first and second award levels. A first set of selectable elements is displayed without informing the player that the first award level has been awarded. The elements mask indicia corresponding to all or a portion of first and second level award criteria. A selection is received of a selectable element from the first set of selectable elements and the indicium for the selected element is revealed. If the indicium for the selected element does not meet the criteria corresponding to the first award level, another set of selectable elements is displayed. A player selection of one of the selectable elements from the another set of elements is received and the indicium for the selected element is revealed. The steps are repeated until a cumulative result of the revealed indicia corresponds to the first level award criteria.

20 Claims, 9 Drawing Sheets

OTHER PUBLICATIONS

International Preliminary Report on Patentability corresponding to International Patent Application Serial No. PCT/US2008/082776, United States Patent Office; dated Feb. 24, 2010; 3 pages.
International Search Report mailed Jan. 9, 2009 for PCT/US2008/082776; 2 pages.
"Quick Pick™ SMI No. 8580"; © 2000 Bally Gaming, Inc.-1000; 2 pages; Shown Oct. 18-20, 2000.
"Pay Time™ SMI No. 8580"; © 2000 Bally Gaming, Inc.-1000; 2 pages; Shown Oct. 18-20, 2000.
"Musical Cherries™ SMI No. 8580"; © 2000 Bally Gaming Systems; 2 pages; Shown Oct. 18-20, 2000.
"FastBall Bingo™ SMI No. 8580"; © 2000 Bally Gaming Systems; 2 pages; Shown Oct. 18-20, 2000.
"Pick a Prize™ SMI No. 8580"; © 2000 Bally Gaming Systems; 2 pages; Shown Oct. 18-20, 2000.
"Let's Boogie™ SMI No. 8580"; © 2000 Bally Gaming Systems; 2 pages; Shown Oct. 18-20, 2000.
"PayTime™ SMI No. 8580"; © 2000 Bally Gaming Systems; 2 pages; Shown Oct. 1-3, 2001.
"Quick Pick PayTime™ SMI No. 8580"; © 2000 Bally Gaming Systems; 2 pages; Shown Oct. 1-3, 2001.

* cited by examiner

WAGERING GAME WITH PLAYER-SELECTABLE ELEMENTS PROVIDING A SCRIPTED OUTCOME

CROSS-REFERENCE To RELATED APPLICATIONS

This application is a U.S. national stage of International Application No. PCT/US2008/082776, filed Nov. 7, 2008, which is related to and claims the benefit of U.S. Provisional Application No. 60/986,943, filed Nov. 9, 2007, each of which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a wagering game having player-selectable elements providing an award based on a scripted sequence.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the invention, a method of playing a wagering game in which a special award may be awarded is disclosed in which the special award has at least a first award level and a second award level. The method includes conducting the wagering game in response to receiving a wager from a player and in response to the special award being awarded to the player in the wagering game, the following steps occur, including: (i) displaying a first set of player-selectable elements without informing the player that the first award level has been awarded to the player and the player-selectable elements mask at least one indicium corresponding to all or a portion of criteria for achieving the first award level and at least one indicium corresponding to a portion of the criteria for achieving the second award level; (ii) receiving a player selection of one of the player-selectable elements from the first set of player-selectable elements and revealing the indicia for the player-selected element; (iii) if the indicium for the player-selected element does not meet the criteria corresponding to the first award level, displaying another set of player-selectable elements without informing the player that the first award level has been awarded to the player, and the player-selectable elements mask at least one indicium corresponding to all or a portion of the criterion for achieving the first award level and at least one indicium corresponding to a portion of the criteria for achieving the second award level; (iv) receiving a player selection of one of the player-selectable elements from the another set of player-selectable elements and revealing the indicium for the player-selected element. Steps (iii) and (iv) are repeated until a cumulative result of the revealed indicia corresponds to the criteria for achieving the first level award so as to inform the player that the first award level has been awarded to the player.

According to another aspect of the invention, a method of playing a wagering game provides at least a first award level and a second award level. Each award level has at least one award associated therewith and a first level award is determined to be awarded to a player. At least two player-selectable elements are displayed with at least one of the player-selectable elements masking a first indicium associated with the first award level and at least a second of the player-selectable elements masking a second indicium associated with the second award level. The selection of at least two player-selectable elements associated with the second award level is required to be selected for the second award level to be awarded. One of the at least two player-selectable elements is selected via player selection. It is next determined whether the selected element is associated with the first award level or the second award level. The masked indicia is revealed for each of the at least two player-selectable elements. In response to the selected element being associated with the first award level, repeating the steps identified above at least one additional time starting with displaying the at least two player-selectable elements and continuing through revealing the masked indicia for each of the at least two player-selectable indicia. An award associated with the first level award is then awarded. In response to the selected element being associated with the second award level, at least two additional player-selectable elements are displayed. Each of the at least two additional player-selectable elements mask an indicium associated with the first award level. One of the at least two additional player-selectable elements is selected via player selection. Only the masked indicium of the selected additional player-selectable element is revealed. The award associated with the first award level is then awarded.

According to another aspect of the present invention, a gaming system for conducting a wagering game in which a special award may be awarded has at least a first award level and a second award level. The system includes a wager input device for receiving a wager from a player and a display for displaying the wagering game in response to receiving the wager from the player. A controller is connected to the display and is adapted to: (a) in response to the special award being awarded to the player in the wagering game, display a first set of player-selectable elements without informing the player that the first award level has been awarded to the player, the player-selectable elements masking at least one indicium corresponding to all or a portion of criteria for achieving the first award level and at least one indicium corresponding to a portion of the criteria for achieving the second award level; (b) receive a player selection of one of the player-selectable elements from the first set of player-selectable elements and reveal the indicium for the player-selected element; (c) if the indicium for the player-selected element does not meet all the criteria corresponding to the first award level, display another set of player-selectable elements without informing the player that the first award level has been awarded to the player, the another set of player-selectable elements masking at least one indicium corresponding to all or a portion of the criterion for achieving the first award level and at least one indicium corresponding to a portion of the criteria for achieving the second award level; (d) receive a player selection of one of the player-selectable elements from the another set of player-selectable elements and reveal the indicium for the player-selected element; and (e) repeat steps (c) and (d) until a cumulative result of the revealed indicia corresponds to the criteria for achieving the first level award so as to inform the player that the first award level has been awarded to the player.

According to another aspect, a method of playing a wagering game is disclosed that provides in which eligibility to at least a first progressive jackpot having a first monetary value and a second progressive jackpot having a second monetary value. The method includes conducting the wagering game in response to receiving a wager from a player. In response to the first progressive jackpot being awarded to the player, a plurality of player-selectable elements masking indicia is displayed for which at least one of the plurality of player-selectable elements masking indicium corresponds to a multiplier value. A player selection of one of the player-selectable elements is received. If the player selection reveals the indicium that corresponds to the multiplier value, an award is provided to the player that corresponds to the first monetary value award as enhanced by the multiplier value.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
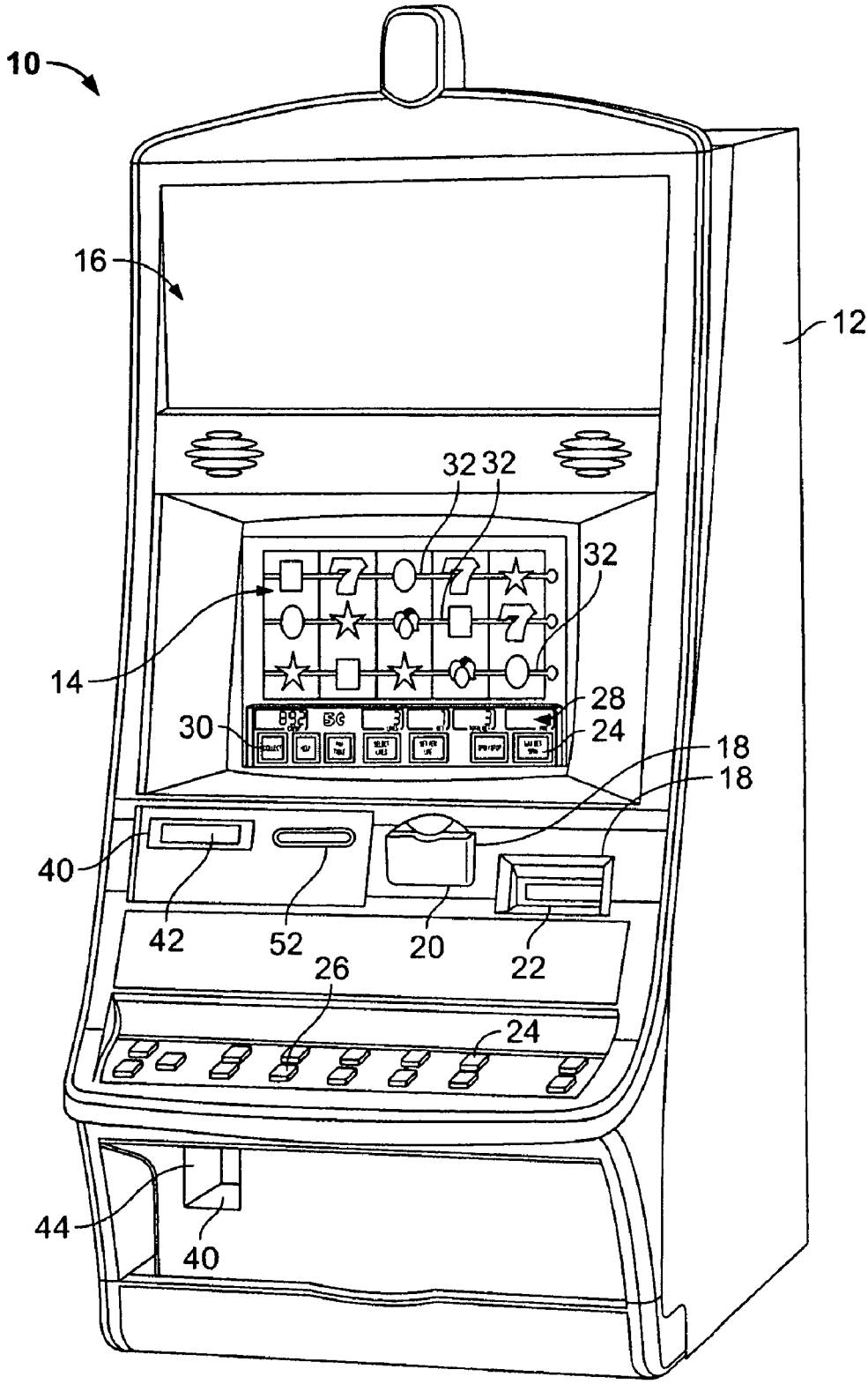
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
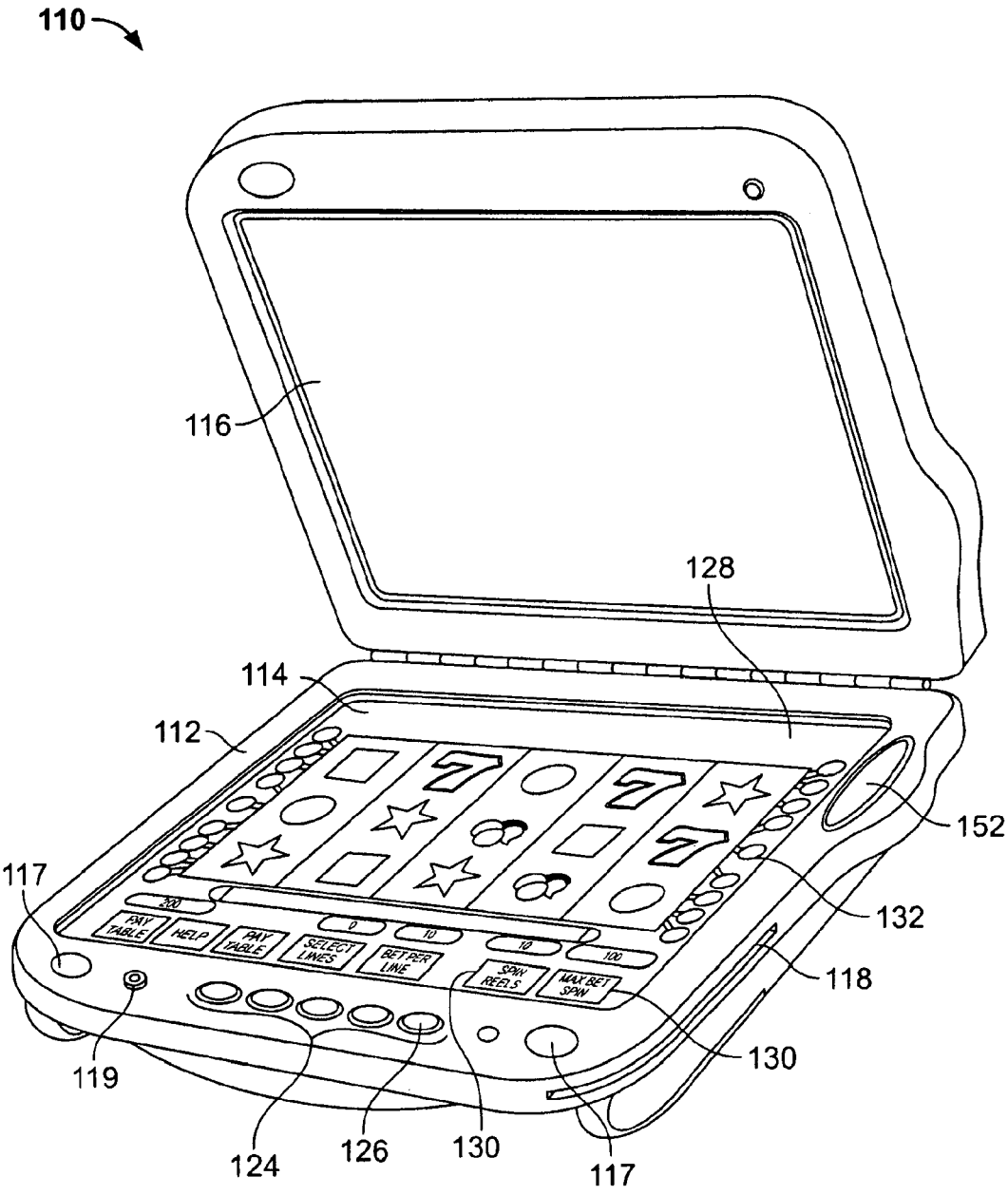
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
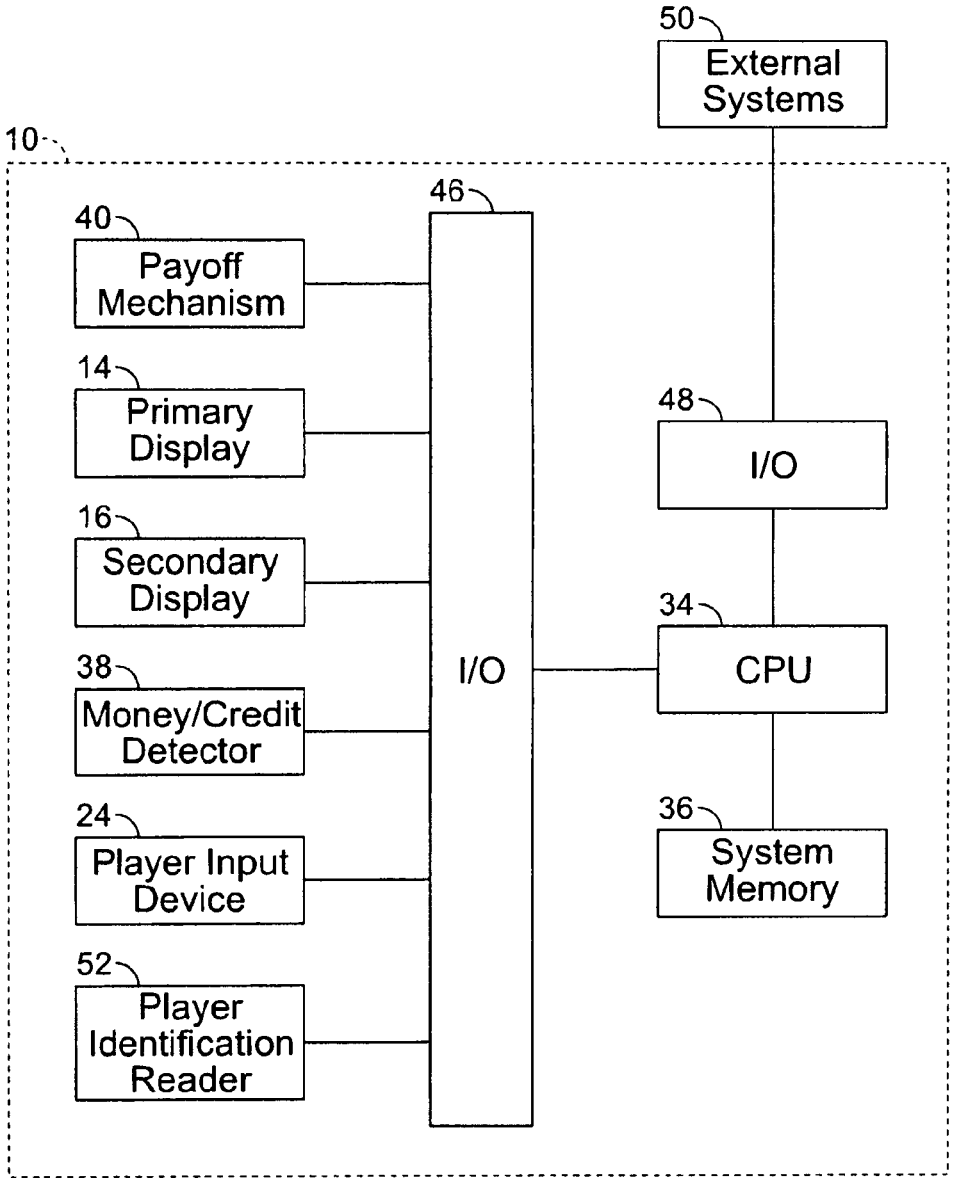
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display (s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Figure 3:
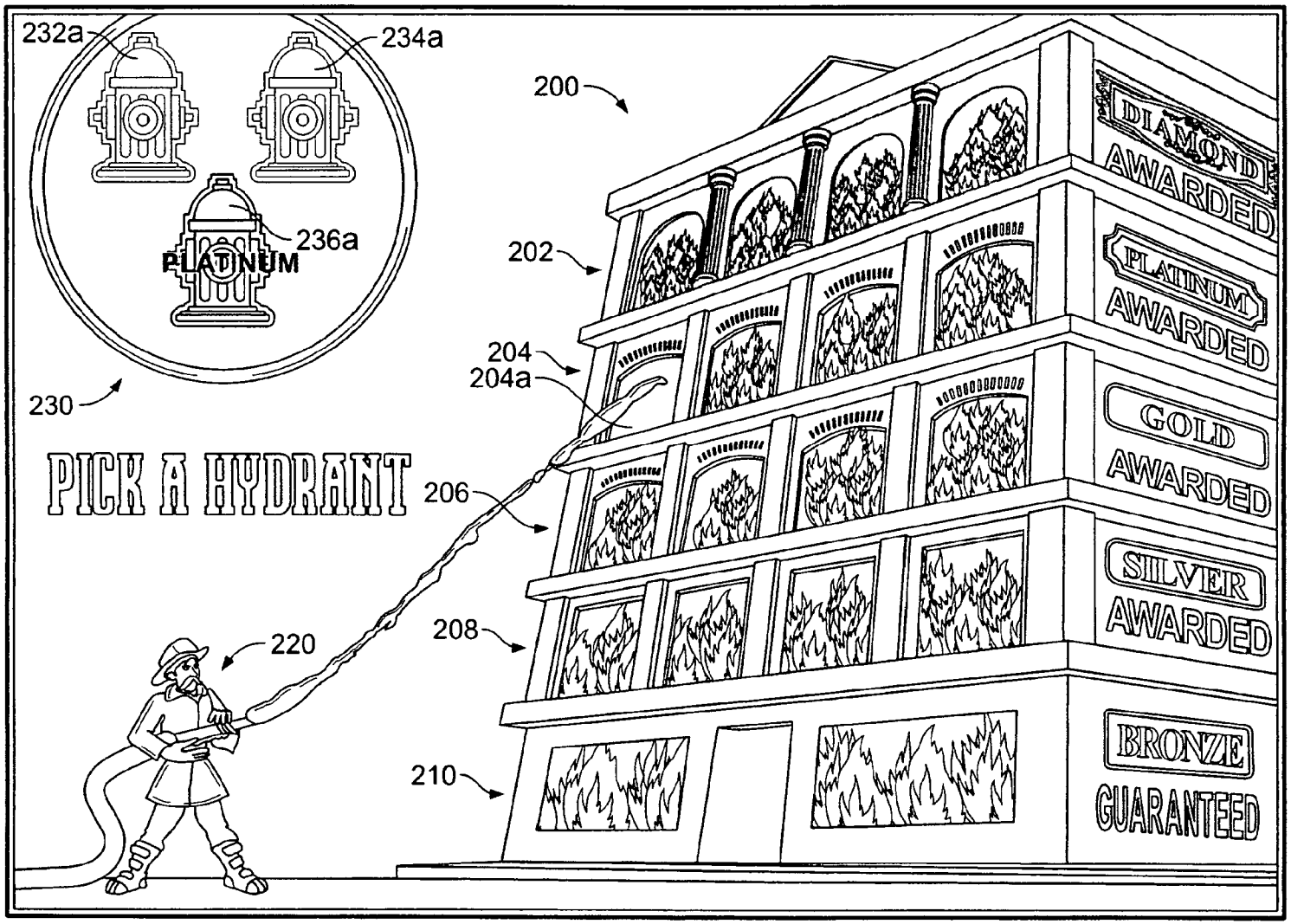
FIG. 3 is a display of a wagering game having player-selectable elements according to one embodiment of the present invention.

Turning now to FIG. 3, an embodiment is illustrated for a wagering game in the example of the MONEY TO BURN® game. The wagering game can include a basic game from which a player may become eligible for a bonus game. A scripted pick and reveal game can be implemented as either a basic game or a bonus game. The bonus game can include, for example, a special award with one or more award levels, or a progressive award with one or more progressive jackpots. In certain embodiments, the amount the player will win is predetermined by the gaming machine 10 at the end of the basic game. In a scripted pick and reveal game, the award levels or jackpots are pre-determined without informing the player that the award has been received or will be received, and without informing the player of the level of the award or jackpot. The player does not have a chance to win one of a variety of credits values through player input (e.g., player-selectable elements). Instead, the player will win a particular, predetermined credit amount, regardless of what input the player provides. For example, although the wagering game may be a fire-extinguishing game with awards, no matter what the player selects, the outcome of the game will be the same. Such games give the appearance of the player having control, although the wagering-game outcome is already known before the player makes any selections.

The player can be presented with the picking game in a bonus round that extends the anticipation of the player by not revealing the received award or bonus. The player initially makes picks or selections from a plurality of player-selectable elements 232*a*, 234*a*, 236*a*, such as the three fire hydrants shown in FIG. 3. The player-selectable elements can be contained within a display screen 230. The player's selection will result in short-term outcomes that do not alter the pre-determined outcome of the bonus round. That is, the ultimate outcome of a given bonus game will be the same, regardless of the type or order of selection of the player-selectable elements 232*a*, 234*a*, 236*a* by the player.

FIG. 3 illustrates a five-level building 200 having four top levels 202, 204, 206, 208 and one bottom level 210. The top four levels each have four windows and the bottom level has two windows. A fireman 220 waits at the ground level with a fire hose and is ready to put out the fires in the windows. The player of the wagering game is given a choice of the three player-selectable elements 232*a*, 234*a*, 236*a* (e.g., the three hydrants). One of the elements 232*a*, 234*a*, 236*a* is then selected by the player to reveal what level the fireman 220 will extinguish. In certain embodiments, the number of windows that may be extinguished is revealed immediately after the player selects an element. In certain embodiments, the number of windows is not immediately revealed to the player. The fireman 220 then sprays a certain number of windows on the revealed level. In the example illustrated in FIG. 3, the player selected element 236*a*, which revealed a previously masked indicia of platinum that refers to the fourth level 204 of the five-story building 200. The fireman 220 proceeds to spray the window 204*a* on the fourth level 204. Prior to the player's selection, the player-selectable element 236*a* masked the indicia or window 204*a* on the platinum or fourth level 204.

A criterion for achieving an award level or progressive jackpot is established by the wagering game prior to the player selecting a player-selectable element. For example, a criterion may be that all four windows on a particular level need to be extinguished before a predetermined award is revealed and/or awarded to a player. All the windows can be extinguished after one selection of the player-selectable element 232*a*, 234*a*, 236*a* or after a plurality of sets of player selectable elements have been selected. In other embodiments, various combinations of windows from various levels are required to be extinguished before the predetermined award is revealed and/or awarded. In other embodiments, after only a certain portion of the windows of the predetermined criteria are extinguished, the criteria can be revealed to the player for achieving the award level despite the player needing to fulfill the remaining criteria before receiving the pre-determined award. In certain embodiments, a portion of the criteria can be updated for one or more award levels that are achieved following a player selection.

In certain embodiments, no level 202, 204, 206, 208, 210 is cleared after the player selects from the first set of player selectable elements 232*a*, 234*a*, 236*a*. The game then continues with another set of player-selectable elements appearing in display screen 230. In certain embodiments, the game is scripted so that the player-selectable elements 232*a*, 234*a*, 236*a* do not correspond to windows or indicia totaling to more than three in the case of the top four levels 202, 204, 206, 208 or one in the case of the bottom level 210. An exception may be made for the level that is pre-determined to be the award level.

Figure 4:
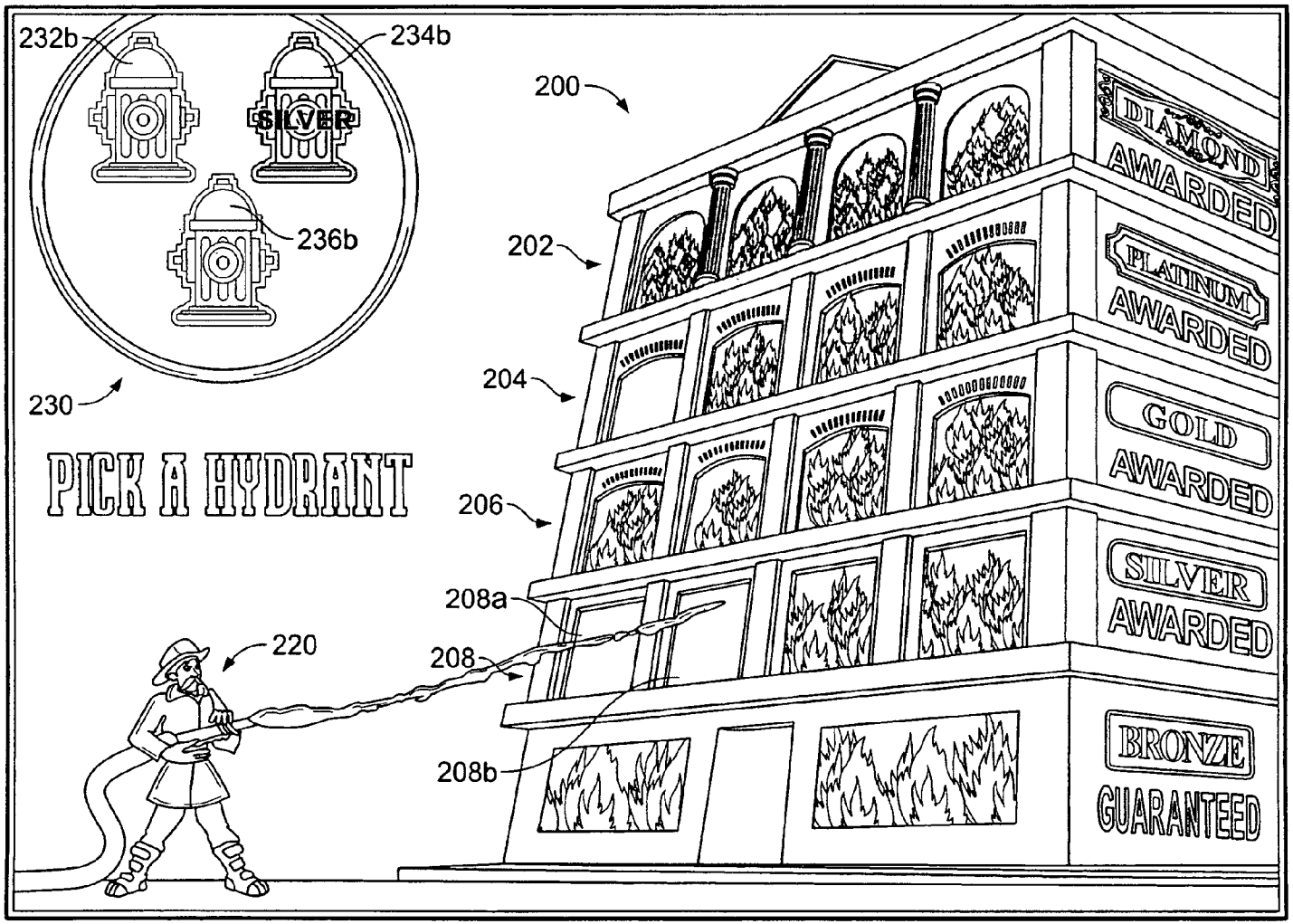
FIG. 4 is a display of a wagering game having player-selectable elements according to another embodiment of the present invention.
Figure 5:
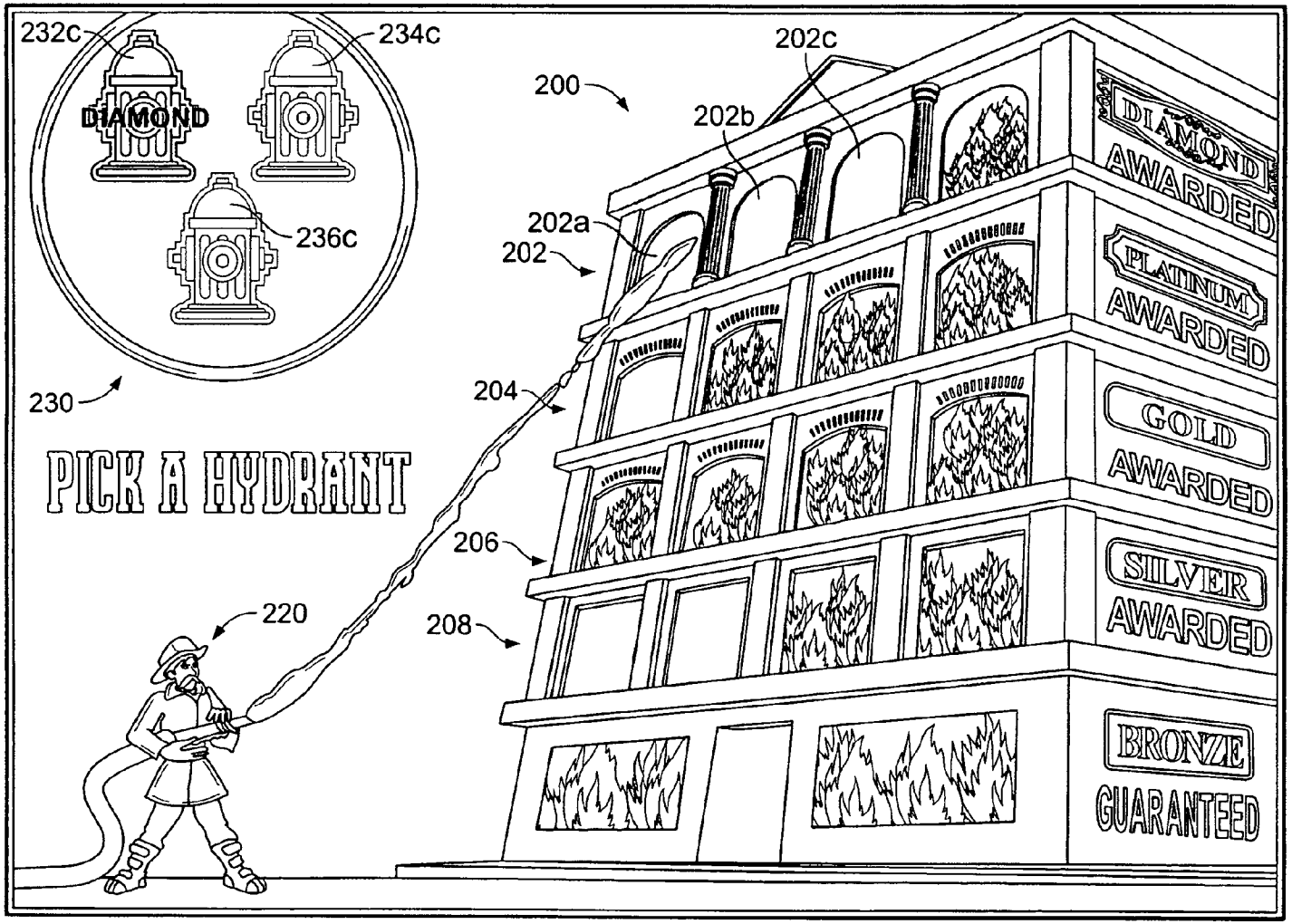
FIG. 5 is a subsequent display of the wagering game in FIG. 4.
Figure 6:
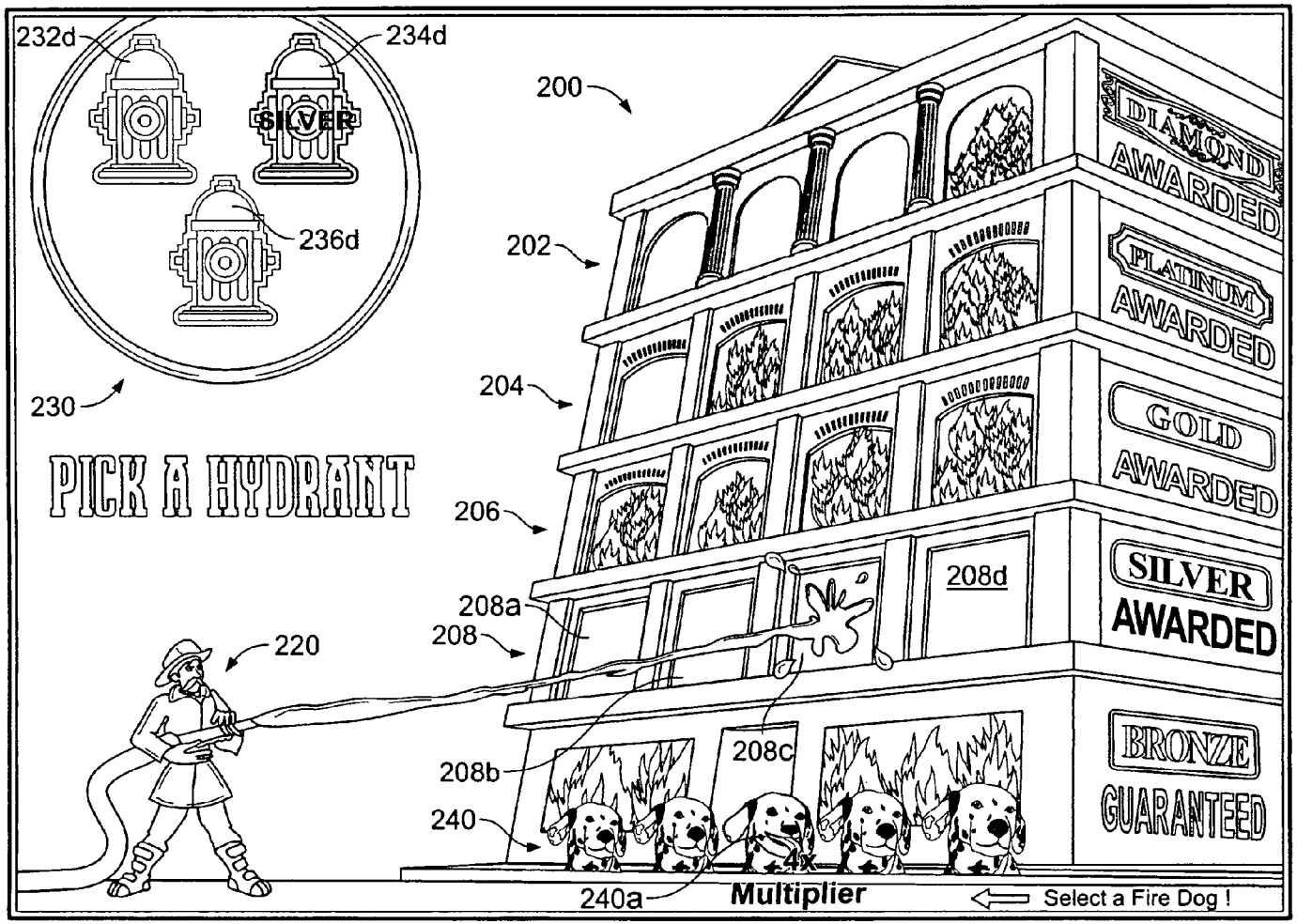
FIG. 6 is a subsequent display of the wagering game in FIG. 4 having an additional award according to one embodiment of the present invention.

Turning now to FIGS. 4-6, a bonus game is illustrated having multiple sets of player-selectable elements 232*b-d*, 234*b-d*, 236*b-d* and a progression for revealing indicia for the player-selectable elements 232, 234, 236 (e.g., hydrants) selected from display screen 230. A scripted sequence is selected by the wagering game. The scripted sequence can be generated randomly using a processor or it may be selected from a series of predetermined scripted sequences. In the embodiment illustrated in FIGS. 4-6, the player has been randomly awarded a silver award (i.e., second level 208) and proceeds to play the scripted bonus game prior to the randomly awarded award level being displayed to the player.

FIG. 5 illustrates a selection step. Before a player makes a selection, player-selectable elements 232*c*, 234*c*, 236*c* mask the indicia. After the player selects element 232*c*, a diamond-level indicium is revealed, which identifies that the diamond level 202 will have certain of its window(s) extinguished by the fireman 220. Three windows 202*a*, 202*b*, 202*c* on the fifth level 202 (e.g., diamond level) of the five-level house 200 are shown to be extinguished in the embodiment illustrated in FIG. 5. The suspense and excitement for the player would generally increase since only one diamond level window remains to be extinguished. This scenario provides the player with the anticipation of a receiving a diamond award.

FIG. 6 illustrates another selection by the player of player-selectable elements 232*d*, 234*d*, 236*d*. In this embodiment, the player selects element 234*d* for which a silver-level indicium is revealed, identifying that the silver level 208 will have certain of its window(s) extinguished by the fireman 220. Two windows 208*c*, 208*d* are shown to be extinguished, which represent the remaining two windows on the second level 208 (e.g., silver level). Since all four of the windows 208*a*, 208*b*, 208*c*, 208*d* on the second level 208 are now extinguished, the player is informed that the player has been awarded the silver award level, or associated jackpot, in the bonus game.

In certain embodiments, a second award level can be awarded to the player through additional player-selectable elements that mask indicia. In certain embodiments, the second award level corresponds to multiplier values. For example, FIG. 6 illustrates a plurality of player-selectable elements 240 (e.g., the heads of five dogs). After the award of a first progressive jackpot (e.g., silver awarded) to a player, the player can select one of the player-selectable elements 240. The player selects, for example, element 240*a* which reveals an indicium for a 4× multiplier that can be applied to the first progressive jackpot. The other player-selectable elements can have a 1×, 2×, 3×, or another multiplier associated with the selectable element.

In certain embodiments, the scripted sequence can include indicia for different levels of the five-level house 200 for a given player selection. For example, FIG. 4 could represent the indicia revealed to a player after the first set of player-selectable elements was selected by the player to reveal platinum indicium and a silver indicium that result in the fireman 220 extinguishing one window on the platinum level 204 and two windows 208*a*, 208*b* on the silver level 208. A scripted sequence can also limit the number of player selections and number of sets of player-selectable elements displayed. For example, a final indicium can be scripted into all the scripted sequences of player-selectable elements such that the final indicium results in all the windows or all the remaining windows for the pre-determined award level to have their fire extinguished. Illustrating this example using FIG. 6, the player selects player-selectable element 234*d*, which results in all the remaining windows 208*c*, 208*d* being extinguished by the fireman 220. However, unknown to the player is that player-selectable elements 232*d*, 236*d* also have a silver indicium. Thus, the scripted sequence can have a final indicium directed to the same level for all of the player-selectable elements. That is, a final script for the game can be configured to end with a set of three hydrants each containing four windows of the pre-determined award level.

In certain embodiments, the amount of time it takes a player to select the player-selectable elements can also be factored into the script so that more selections or less selections are allowed for a particular scripted game. A scripted sequence can also be altered depending on the player-selected elements. Furthermore, an alternative display screen can be displayed in response to a player selecting a certain player-selectable element in a previous display screen.

Figure 7:
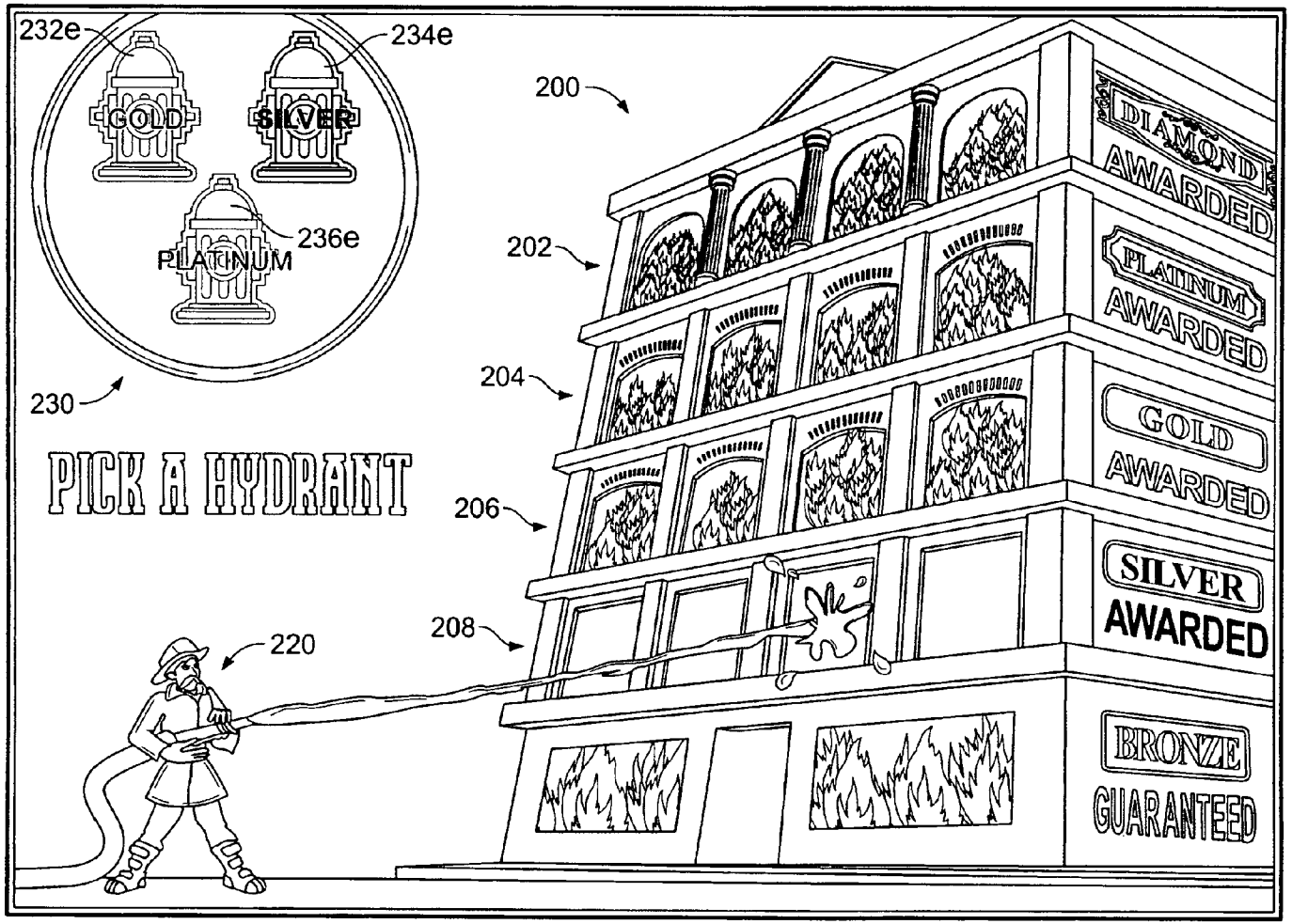
FIG. 7 is a display of a wagering game having player-selectable elements according to another embodiment of the present invention.

Turning now to FIG. 7, certain embodiments are illustrated for the player-selectable elements 232*e*, 234*e*, 236*e*. After an element 232*e*, 234*e*, 236*e* is selected by a player, the non-selected elements can be revealed. For example, player-selectable element 232*e* is highlighted to illustrated that element 232*e* was selected by the player and the indicium for silver is then revealed to the player. Non-selected elements 232*e*, 236*e* can also reveal to the player the indicia the player would have obtained had one of the non-selected elements 232*e*, 236*e* been chosen. However, if the player reaches a final pick or selection in which all the hydrants have identical indicia, then the non-selected outcomes are not revealed. In certain embodiments, non-selected picks are not revealed. In other embodiments, the player-selectable element are directed to indicia for different levels.

In certain embodiments, the game can be scripted so that a player is allowed to make picks that result in short-term outcomes without altering the pre-determined outcome of the bonus round. For example, a player may be allowed to make certain selections of the player-selectable elements 232, 234, 236 in which the revealed indicia are randomly determined. However, at a certain point in the game, the script may force the revealing of limited indicia so that the pre-determined award level is cleared. In the embodiment of FIG. 7, one manner of accomplishing such a goal is to establish a script in which the hydrant picks can not have a total number of extinguished windows greater than three for levels 202, 204, 206, 208 or one for the bottom level (e.g., bronze), except for the pre-determined award level.

While multiple scripts could be established based on the criteria disclosed herein, an example of script is now illustrated in which the player has won a pre-determined award silver level. The script may have the following indicia associated with a first set of player-selectable elements 232, 234, 236 (along with the number of windows that are extinguished, in parentheses): silver (two windows), platinum (two windows), gold (three windows). Since no selection from the first set of player-selectable elements cleared a complete level, the player will have a second round or a second set of player-selectable elements from which to choose. Furthermore, no more indicia for gold will be masked by the hydrants since the clearing of one more gold window violates the pre-determined silver award level.

For the second set of player-selectable elements in the continuation of the game, the following indicia (and cleared windows) are associated with the hydrants: silver (two windows), platinum (one window), diamond (three windows). If the player selected the hydrant that had both silver indicia, the bonus game would be complete and the player would receive the silver award level. Otherwise, no other combination of selections cleared an award level, requiring a third set of player-selectable elements. The third set, could have the following indicia: silver (two windows), silver (two windows), bronze (one window). The third set masks two silver indicia in the player-selectable elements to increase the chance of the player clearing the silver level. If, however, the player still has not cleared the silver level, a fourth set of player-selectable element can be displayed from which the player can select. The fourth set may be scripted with the following indicia: silver (four windows), silver (four windows), silver (four windows). The fourth set in this example game ensures that the silver award level with be received by the player no matter what the player's previous picks. A script can be ended such that a final set of player-selectable elements have four windows of the pre-determined award level (e.g., silver).

By using a scripting method as described above, the player feels like they are in control of their own destiny when, in reality, the award they will receive has been predetermined. In classic scripting methods, the non-selected player-selectable elements can not be displayed to a player because, regardless of which of the selectable elements the player actually selects, the result will be the same. Thus, because the player can only select one outcome, regardless of which element they choose, there can be no reveal to the player of the other possible outcomes of their selection, because no other outcomes are possible.

Figure 8:
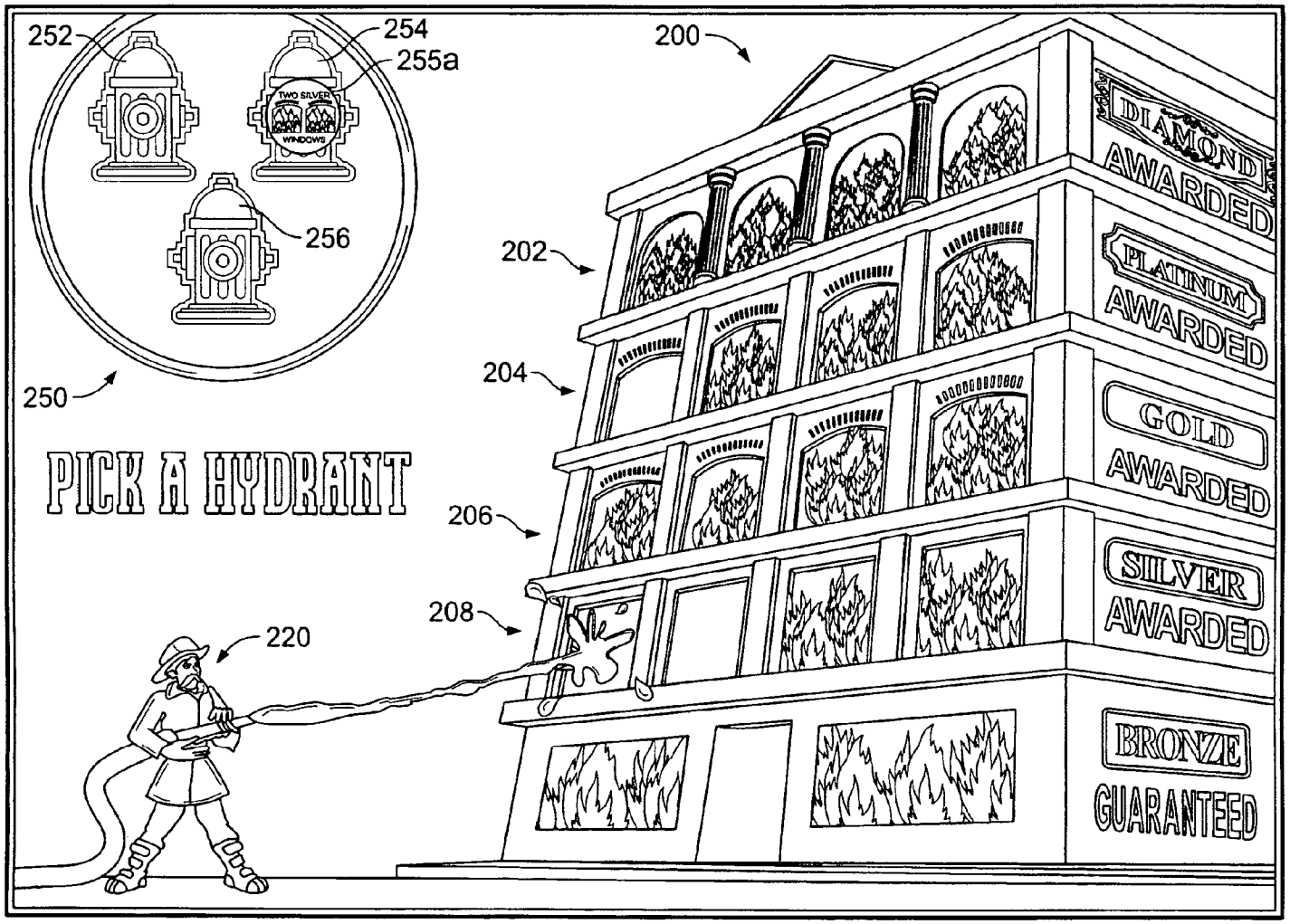
FIG. 8 is a display of a wagering game having player-selectable elements according to another embodiment of the present invention.

Turning now to FIG. 8, an embodiment for the player-selectable elements 252, 254, 256 is illustrated. The revealed indicia in display screen 250 can display the award level and the number of windows the player achieved by selecting a particular element. For example, the player selects element 254 which reveals a silver indicium 255*a* and further identifies that two windows are to be extinguished on the silver level 208. In certain embodiments, the selection of player-selectable element 254 could have revealed (i) a gold indicium and a silver indicium, (ii) two platinum windows, one gold window and one silver window, etc.

The systems and methods described herein can require multiple scripts to be established for each award level. A script can then be randomly chosen from a plurality of scripted sequences after an award level is determined by the controller 34. The scripting of the embodiments described herein can create a greater deal of anticipation and surprise to the player than previous scripted games, since the selections that control the length of the player-gaming machine interaction are controlled by the player. The length of the interaction can add a great deal of variability to the sequence a script takes, without changing the final pre-determined outcome of the script.

Each of these embodiments and obvious variations thereof is contemplated as falling within the spirit and scope of the claimed invention, which is set forth in the following claims.

What is claimed is:

1. A method of playing a wagering game in which a special award may be awarded, the special award having at least a first award level and a second award level, the method comprising:

conducting the wagering game in response to receiving a wager from a player; and in response to the special award being awarded to the player in the wagering game, (i) displaying, on a display, a first set of player-selectable elements without informing the player that the first award level has been awarded to the player, the player-selectable elements masking at least one indicium corresponding to all or a portion of criteria for achieving the first award level and at least one indicium corresponding to a portion of the criteria for achieving the second award level, at least one of the indicia being randomly determined;

(ii) receiving, via an input device, a player selection of one of the player-selectable elements from the first set of player-selectable elements and revealing the indicium for the player-selected element;

(iii) if the indicium for the player-selected element does not meet all the criteria corresponding to the first award level, displaying another set of player-selectable elements without informing the player that the first award level has been awarded to the player, the another set of player-selectable elements masking at least one indicium corresponding to all or a portion of the criterion for achieving the first award level and at least one indicium corresponding to a portion of the criteria for achieving the second award level;

(iv) receiving a player selection of one of the player-selectable elements from the another set of player-selectable elements and revealing the indicium for the player-selected element; and (v) repeating steps (iii) and (iv) until a cumulative result of the revealed indicia corresponds to the criteria for achieving the first award level so as to inform the player that the first award level has been awarded to the player.

2. The method of claim 1, further including displaying the criteria for achieving the first award level and the second award level to the player and updating the portion of the criteria for the first award level and second award level that has been achieved after each player selection.

3. The method of claim 1, further including revealing the indicia for the unselected player-selectable elements to inform the player what would have been achieved with a different selection.

4. The method of claim 1, wherein the wagering game includes a basic game and a bonus game, the displaying of player-selectable elements and receiving of player selections being associated with the bonus game.

5. The method of claim 1, wherein the wagering game includes a basic game and provides eligibility to a progressive game, the first award level and the second award level being, respectively, a first progressive jackpot and a second progressive jackpot, the displaying of player-selectable elements and receiving of player selections being associated with the progressive game.

6. The method of claim 1, wherein in response to a randomly selected outcome in the wagering game being a second-award-level triggering outcome, (i) displaying a second set of player-selectable elements without informing the player that the player has been awarded the second award level, the second set of player-selectable elements masking indicia that correspond to at least a portion of a criteria for achieving the second award level;

(ii) receiving a player selection of one of the player-selectable elements from the second set of player-selectable elements and revealing the indicium for the player-selected element;

(iii) if the indicium for the player-selected element does not meet the criteria corresponding to the second award level, displaying another second set of player-selectable elements without informing the player that the player has been awarded the second award level, the player-selectable elements masking indicia that correspond to a portion of a criteria for achieving the second award level;

(iv) receiving a player selection of one of the player-selectable elements from the another second set of player-selectable elements and revealing the indicium for the player-selected element; and (v) repeating steps (iii) and (iv) until a cumulative result of the revealed indicia corresponds to the criteria for achieving the second level award so as to inform the player that the player has been awarded the second award level.

7. The method of claim 1, wherein the displaying steps of (i) and (iii) are part of a scripted sequence of displaying steps that always cause the cumulative result of the revealed indicia to correspond to the criteria for achieving the first level award.

8. The method of claim 7, wherein the scripted sequence of displaying steps is altered depending on the player-selected elements.

9. The method of claim 7, wherein the scripted sequence of displaying steps is selected from a plurality of scripted sequences that always cause the cumulative result of the revealed indicia to correspond to the criteria for achieving the first level award.

10. The method of claim 1, wherein the conducting the wagering game is performed by a processor within a gaming machine at which the wagering game is being played.

11. A method of conducting a wagering game, comprising:

(i) providing at least a first award level and a second award level, each award level having at least one award associated therewith;

(ii) determining to award a player the first award level;

(iii) displaying, on a display, at least two player-selectable elements, at least one of the player-selectable elements masking a first indicium associated with the first award level and at least a second of the player-selectable elements masking a second indicium associated with the second award level, at least one of the indicia being randomly determined;

(iv) requiring the selection of at least two player-selectable elements associated with the second award level to be selected for the second award level to be awarded;

(v) selecting, via player selection associated with an input device, one of the at least two player-selectable elements;

(vi) determining whether the selected element is associated with the first award level or the second award level;

(vii) revealing the masked indicia for each of the at least two player-selectable elements;

(viii) in response to the selected element being associated with the first award level, a) repeating steps (iii)-(vii) at least one additional time; and b) awarding the award associated with the first award level; and (ix) in response to the selected element being associated with the second award level, a) displaying at least two additional player-selectable elements, each of the at least two additional player-selectable elements masking an indicium associated with the first award level, b) selecting, via player selection, one of the at least two additional player-selectable elements, c) revealing only the masked indicium of the selected additional player-selectable element, and d) awarding the award associated with the first award level.

12. A gaming system for conducting a wagering game in which a special award may be awarded, the special award having at least a first award level and a second award level, the system comprising:

a wager input device for receiving a wager from a player;

a display for displaying the wagering game in response to receiving the wager from the player;

a controller connected to the display and adapted to, (a) in response to the special award being awarded to the player in the wagering game, display a first set of player-selectable elements without informing the player that the first award level has been awarded to the player, the player-selectable elements masking at least one indicium corresponding to all or a portion of criteria for achieving the first award level and at least one indicium corresponding to a portion of the criteria for achieving the second award level, at least one of the indicia being randomly determined;

(b) receive a player selection of one of the player-selectable elements from the first set of player-selectable elements and reveal the indicium for the player-selected element;

(c) if the indicium for the player-selected element does not meet all the criteria corresponding to the first award level, display another set of player-selectable elements without informing the player that the first award level has been awarded to the player, the another set of player-selectable elements masking at least one indicium corresponding to all or a portion of the criterion for achieving the first award level and at least one indicium corresponding to a portion of the criteria for achieving the second award level;

(d) receive a player selection of one of the player-selectable elements from the another set of player-selectable elements and reveal the indicium for the player-selected element; and (e) repeat steps (c) and (d) until a cumulative result of the revealed indicia corresponds to the criteria for achieving the first level award so as to inform the player that the first award level has been awarded to the player.

13. The system of claim 12, wherein the controller is further adapted to display the criteria for achieving the first award level and the second award level to the player and update the portion of the criteria for the first award level and second award level that has been achieved after each player selection.

14. The system of claim 12, wherein the controller is further adapted to reveal the indicia for the unselected player-selectable elements to inform the player what would have been achieved with a different selection.

15. The system of claim 12, wherein the wagering game includes a basic game and a bonus game, the displaying of player-selectable elements and receiving of player selections through the controller being associated with the bonus game.

16. The system of claim 12, wherein the wagering game includes a basic game and provides eligibility to a progressive game, the first award level and the second award level being, respectively, a first progressive jackpot and a second progressive jackpot, the displaying of player-selectable elements and receiving of player selections through the controller being associated with the progressive game.

17. The system of claim 12, wherein in response to a randomly selected outcome in the wagering game being a second-award-level triggering outcome, the controller is further adapted to:

(i) display a second set of player-selectable elements without informing the player that the player has been awarded the second award level, the second set of player-selectable elements masking indicia that correspond to at least a portion of a criteria for achieving the second award level;

(ii) receive a player selection of one of the player-selectable elements from the second set of player-selectable elements and reveal the indicium for the player-selected element;

(iii) if the indicium for the player-selected element does not meet the criteria corresponding to the second award level, display another second set of player-selectable elements without informing the player that the player has been awarded the second award level, the player-selectable elements masking indicia that correspond to a portion of a criteria for achieving the second award level;

(iv) receive a player selection of one of the player-selectable elements from the another second set of player-selectable elements and reveal the indicium for the player-selected element; and (v) repeat steps (iii) and (iv) until a cumulative result of the revealed indicia corresponds to the criteria for achieving the second level award so as to inform the player that the player has been awarded the second award level.

18. The system of claim 12, wherein the display through the controller of steps of (a) and (c) are part of a scripted sequence of displaying steps that always cause the cumulative result of the revealed indicia to correspond to the criteria for achieving the first level award.

19. The system of claim 18, wherein the scripted sequence of displaying steps is altered depending on the player-selected elements.

20. The method of claim 18, wherein the scripted sequence of displaying steps is selected from a plurality of scripted sequences that always cause the cumulative result of the revealed indicia to correspond to the criteria for achieving the first level award.

* * * * *